US006543352B1

(12) United States Patent
Dilling et al.

(10) Patent No.: US 6,543,352 B1
(45) Date of Patent: Apr. 8, 2003

(54) PRINTING UNIT

(75) Inventors: Peer Dilling, Friedberg (DE); Horst Dauer, Rohrbach (DE); Josef Göttling, Friedberg (DE); Godber Petersen, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/635,316

(22) Filed: Aug. 9, 2000

(30) Foreign Application Priority Data

Aug. 10, 1999 (DE) ..... 199 37 804

(51) Int. Cl.[7] ..... B41F 5/00
(52) U.S. Cl. ..... 101/220; 101/216; 101/247
(58) Field of Search ..... 101/175, 176, 101/178, 179, 180, 182, 183, 216, 217, 218, 219, 220, 221, 247, 153

(56) References Cited

U.S. PATENT DOCUMENTS

| | | | | |
|---|---|---|---|---|
| 4,643,090 A | * | 2/1987 | McKrell | 101/218 |
| 5,063,844 A | | 11/1991 | Fausel | |
| 5,520,109 A | | 5/1996 | Meschi | |
| 5,588,362 A | * | 12/1996 | Sugiyama | 101/218 |
| 5,806,427 A | | 9/1998 | Niemiro et al. | |
| 5,868,071 A | | 2/1999 | Niemiro et al. | |
| 6,085,650 A | * | 7/2000 | Petersen | 101/220 |

FOREIGN PATENT DOCUMENTS

| | | |
|---|---|---|
| CH | 588 942 | 6/1977 |
| DE | 645 820 | 6/1937 |
| DE | 44 02 389 | 9/1994 |
| DE | 195 34 651 A1 | 3/1997 |
| DE | 198 05 898 A1 | 11/1999 |

* cited by examiner

*Primary Examiner*—Andrew H. Hirshfeld
*Assistant Examiner*—Kevin D. Williams
(74) *Attorney, Agent, or Firm*—Cohen, Pontani, Lieberman & Pavane

(57) ABSTRACT

A printing unit for a web fed rotary printing machine is provided including a machine frame support, two sets of printing unit cylinders, carriages, drive motors and guide elements. The two sets of printing unit cylinders, include a plurality of outer printing unit cylinders and a plurality of inner printing unit cylinders. Each carriage corresponds to one printing unit cylinder for rotatably mounting its corresponding printing unit cylinder on the machine frame support. There is a drive motor for each carriage. Two sets of guide elements are arranged on the machine frame for determining a travel setting of the plurality of carriages along the machine frame support. The guide elements for the outer cylinders are arranged on the frame support in an orientation different than the guide elements for the inner cylinders so that movement of the outer printing unit cylinders is in a different direction than movement of the inner printing unit cylinders. Optionally, the printing unit accommodates additional printing devices that are moveable in relation to their corresponding cylinders and vice versa.

20 Claims, 6 Drawing Sheets

PRINTING UNIT

BACKGROUND OF THE INVENTION

1. Field of the Invention

The present invention relates to a printing unit for a web fed rotary printing machine, having a plurality of printing unit cylinders each having their own drive motor. The printing unit cylinders can be set in relation to one another on guide elements. More particularly, the present invention is a printing unit designed to have smaller dimensions than a conventional printing unit while being able to perform the same functions.

2. Description of the Related Art

German reference No. 195 34 651.3 discloses a web fed rotary printing machine in which the adjustable printing unit cylinders are mounted on carriages displaceable on guide elements. The guide elements are arranged on walls of the machine frame which run parallel to the end faces of the printing unit cylinders. All the guide elements at one end of the printing unit cylinders are aligned with one another.

SUMMARY OF THE INVENTION

The object of the present invention is to provide a simple structure for a compact space saving printing unit.

The present invention is a printing unit for a web fed rotary printing machine including a machine frame support, two sets of printing unit cylinders, carriages, drive motors and guide elements. The two sets of printing unit cylinders include a plurality of outer printing unit cylinders and a plurality of inner printing unit cylinders. Each carriage corresponds to one printing unit cylinder for rotatably mounting the printing unit cylinder on the machine frame support. There is a drive motor for each carriage. Two sets of guide elements are arranged on the machine frame for determining a travel setting of the plurality of carriages along the machine frame support. The guide elements for the outer cylinders are arranged on the machine frame support in an orientation different than the guide elements for the inner cylinders so that movement of the outer printing unit cylinders is in a different direction than movement of the inner printing unit cylinders.

Advantageously, the guide elements are rectilinear and are fitted to a frame wall that runs perpendicular to a plane drawn through the end faces of the printing cylinders, otherwise referred to as lateral to the ends of the cylinders. By this design it is possible to minimize the dimensions of the printing unit in the direction of movement of the printing web.

Advantageously, the printing unit accommodates additional printing devices that are moveable in relation to their corresponding cylinders and vice versa.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, the present invention is illustrated schematically as follows.

DETAILED DESCRIPTION OF THE PRESENTLY PREFERRED EMBODIMENTS

Figure 1:
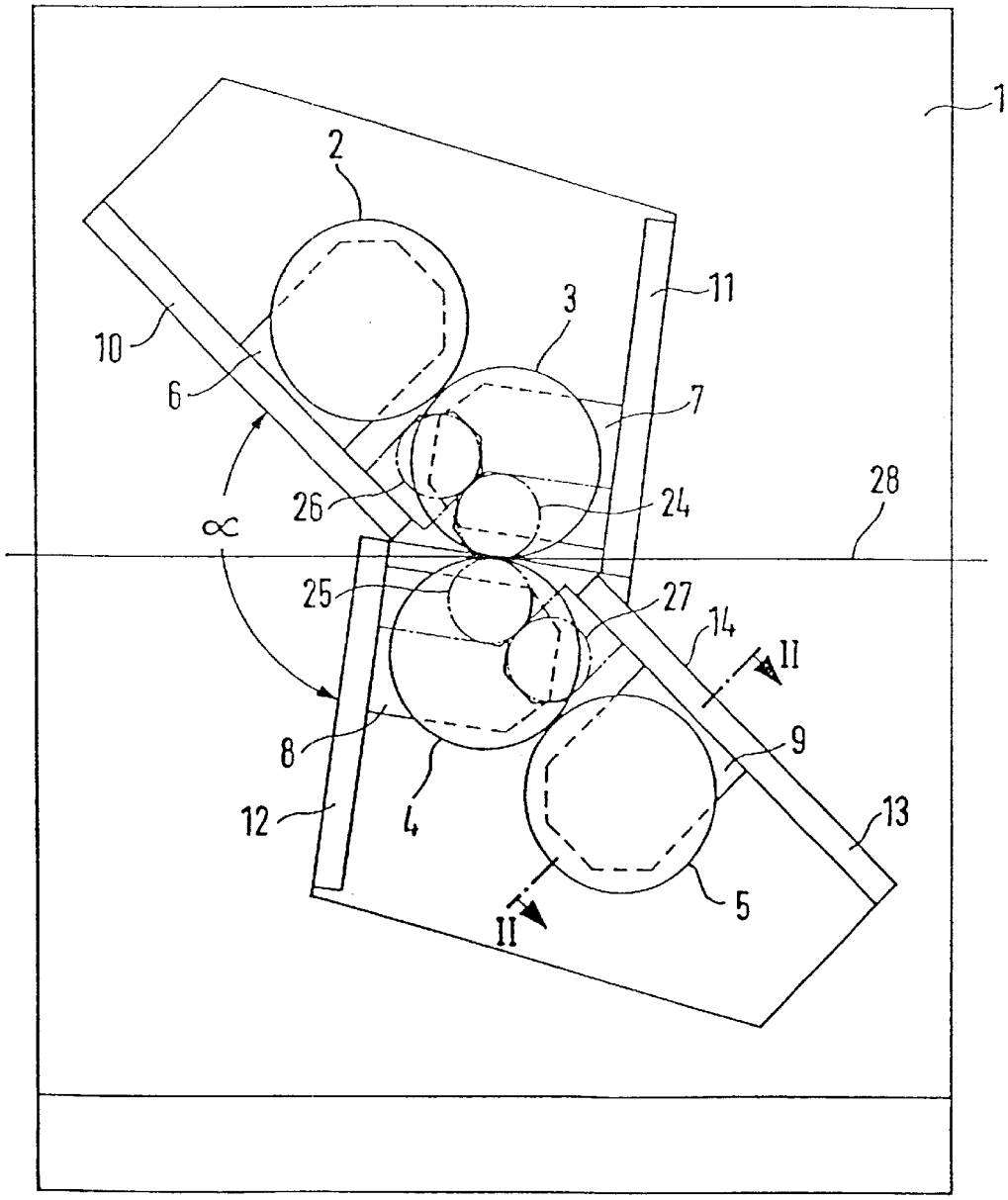
FIG. 1 is a side view of a printing unit according to the present invention.

Referring to FIG. 1, a printing unit according to the present invention is shown. The printing unit has a machine frame support 1 with four adjustable printing unit cylinders 2–5. Each printing unit cylinder is rotatably mounted on a carriage 6–9 that accommodates a drive motor (not illustrated) for the respective printing unit cylinder. Drive motors of this type are disclosed in the U.S. patent application Ser. No. 09/635,155. Guide elements 10–13 are provided to guide the carriages 6–9.

Figure 2:
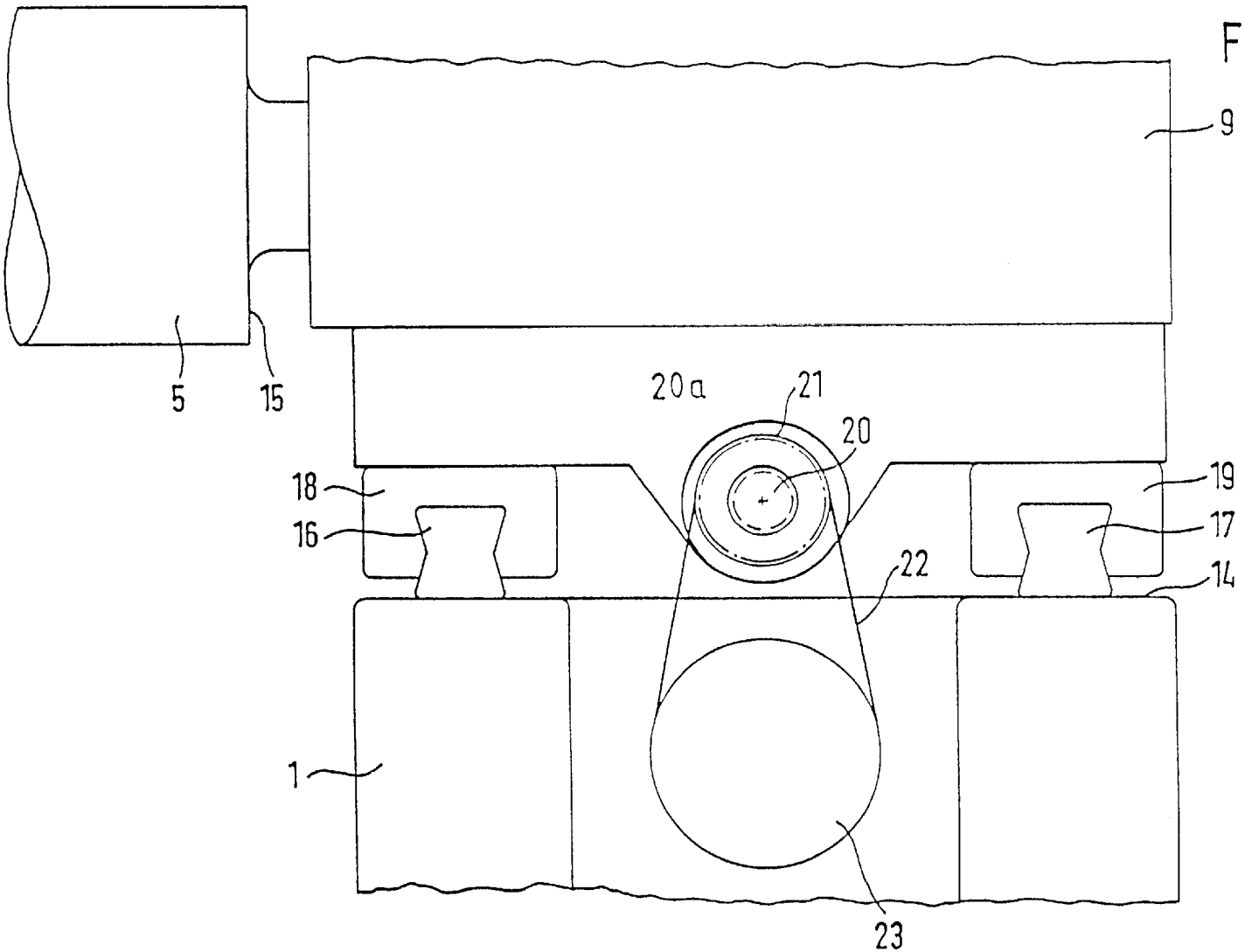
FIG. 2 is a sectional view along the line II—II in FIG. 1.

Referring now to FIG. 2, a machine frame support 1 has a wall 14 which runs laterally beside an end 15 of the printing unit cylinder. Two parallel guide rails 16, 17 have a dovetail like cross section. Sliding shoes 18, 19, which are permanently mounted on the wall 14 are identified as the guide element 13. In this embodiment, the guide rails 16, 17 have a dovetail like cross section. Sliding shoes 18, 19 which are permanently connected to the carriage 9, engage over the guide rails 16, 17. The carriage can get set with high accuracy with respect to the machine frame support 1 using this form-fitting guide system.

Each carriage permanently accommodates a screw spindle 20 engaged in a threaded nut 20*a* for adjusting the position of the carriage. The screw spindle 20 extends parallel to the guide rails 16, 17 and is mounted on the machine frame support 1 so that it can be rotated but may not be displaced axially. A gear wheel 21 is fitted to the screw spindle 20. The gear wheel 21 is driven via a chain drive 22 or the like attached to a motor 23. The motor can be, for example, an electric motor that is also permanently connected to the machine frame 1. Other suitable means for transmitting an adjustment movement to the carriages can also be provided, for example, a belt drive.

If the printing cylinders 2–5 are not intended to be cantilever mounted, then an identical machine frame support as previously described must be arranged laterally beside the other end of the printing unit cylinders. In the example illustrated in FIG. 1, the printing material web 28 runs approximately horizontally. However, it is also conceivable for a vertical run of the web 28 to be possible by rotating the design by 90°.

Referring again to FIG. 1, the guide elements 11, 12 for the carriages 7, 8 of the inner printing unit cylinders 3, 4 are spaced apart from and are parallel to one another. The guide elements 10, 13 for carriages 6, 9 of the outer printing unit cylinders 2, 5 run obliquely with respect to the guide elements 11, 12 of the inner printing unit cylinders 3, 4. These guide elements 10, 13 are also spaced apart from and are parallel to one another. The difference in directions between the guides 10, 12 and 11, 13 is indicated by the angle $\alpha$. The adjusting motion of the outer printing unit cylinders 2, 5 in the direction of the guide elements 10, 13, is in an up and down direction and becomes smaller as the angle α between the guide elements 10, 12 and 11, 13 respectively, decreases. In this way, the overall height of the printing unit illustrated in FIG. 1, in which the passage of the printing material web 28 is approximately horizontal, can be minimized. If the printing unit is used with a vertical passage of the printing material web 28, the width of the printing unit can be minimized.

FIG. 1 shows the printing unit in the print-on position. In order to transfer into the print-off position, the carriages 6, 9 of the outer printing unit cylinders 2, 5 are first moved outward. The carriages 7, 8 of the inner printing unit cylinders 3, 4 can then be moved up and down, respectively, until all of the printing unit cylinders have been lifted off of one another. In this position, cantilever mounted sleeves of the printing unit cylinders can be changed. If the cylinders are mounted at both ends, then one machine frame support 1 must be configured so that it can be folded out or displaced in some way in order to allow one end of the printing unit cylinders to be free. Arrangements of this type are described in the U.S. patent application Ser. No. 09/635,155.

The outer cylinders may be designed as plate cylinders and may also be assigned additional or auxiliary units such as image setting devices, inking units and the like. The cylinders can be moved, preferably in the working direction of the auxiliary units. In addition, the auxiliary units can be moved to their respective cylinder, preferably in the direction of movement of the cylinder. To this end, the guide elements assigned to the outer cylinders 2, 5 extend until they are in the area of the associated auxiliary device, so that separate guides are not necessary.

In FIG. 1, the printing unit cylinders having the smallest useable diameters are shown as 24–27. The printing unit of the present invention can be used for considerably smaller printing unit cylinders than conventional printing units. The closer the angle approaches 180°, the easier it is to use a single machine frame support. When there are excessively large differences in diameter it will no longer be possible to use a single printing unit and adaptations of the machine frame support will have to be used.

It is possible to perform offset or indirect flexographic or gravure printing on both sides using the configuration of printing unit cylinders 2–5 as illustrated.

Figure 3:
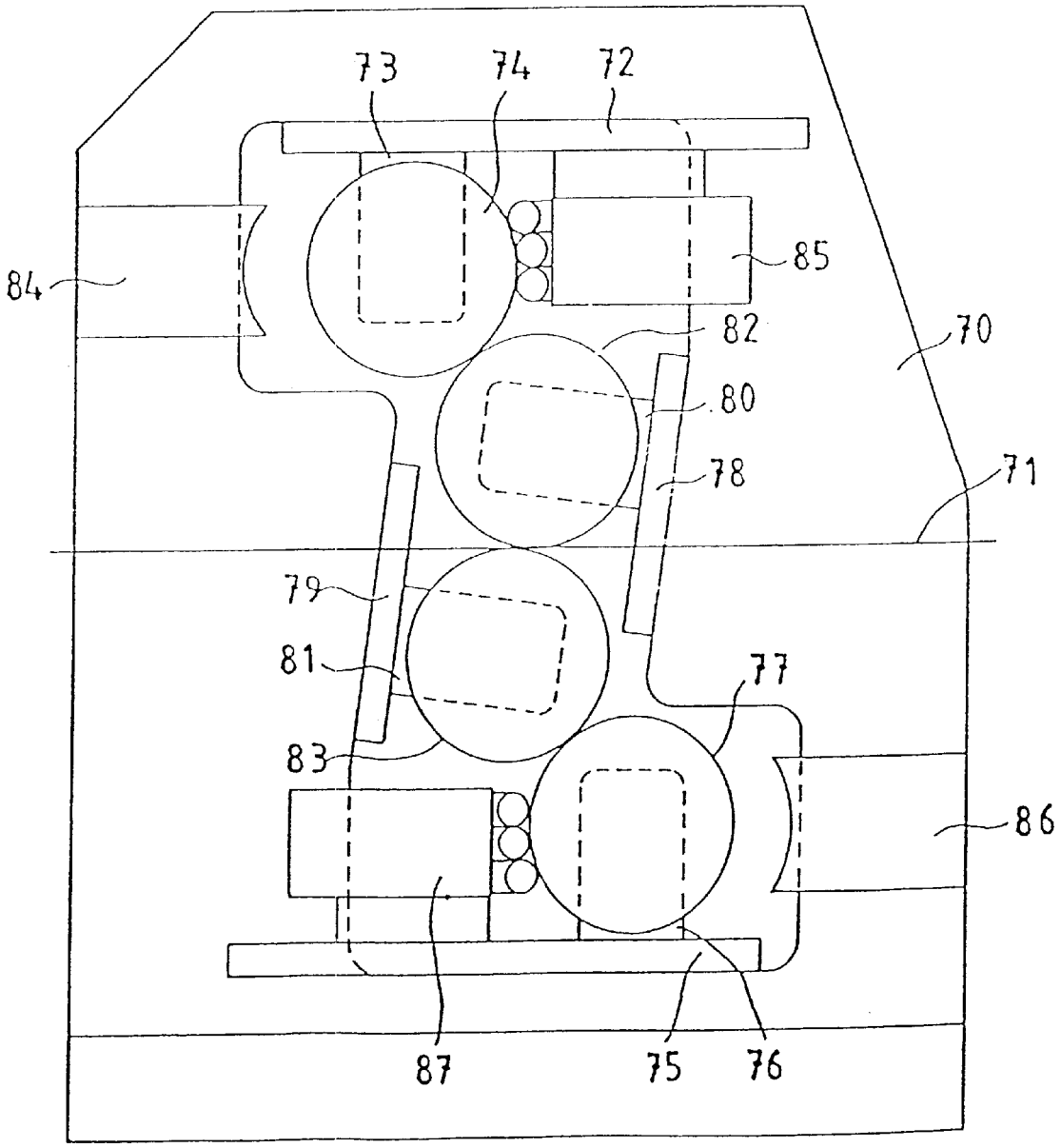
FIG. 3 is another embodiment of the present invention.

Referring now to FIG. 3, a further embodiment of the present invention is shown. The four cylinder printing unit according to FIG. 3 has an approximately horizontal rectilinear guide element 72 that runs approximately parallel to the run of the printing material web 71 (guided horizontally) and is arranged in the upper area of the machine frame support 70. The guide element 72 is provided for a carriage 73 of a plate cylinder 74. A further guide element 75, that also runs approximately parallel to the run of the printing material web 71, is arranged in the lower area of the machine frame support 70. This guide element 75 is provided for a carriage of plate cylinder 77. The two guide elements 72, 75 are spaced apart from and run parallel to one another. Two rectilinear guide elements 78, 79 are arranged between the guide elements 72, 75 and are also spaced apart from and parallel to one another. These rectilinear guide elements 78, 79 are provided for carriages 80, 81 of the transfer cylinders 82, 83 and run obliquely with respect to the guide elements 72, 75 for the plate cylinders 74, 77. Preferably, the angle of guide elements 78, 79 with respect to guide elements 72, 75 is approximately 90°.

An image setting device 84 is permanently arranged in the upper area of the machine frame support 70. The plate cylinder 74 can be brought into contact with the image setting device 84 by displacement of its carriage 73 to one end of the guide element 72. In this case, the plate cylinder 74 simultaneously lifts off the transfer cylinder 82. In addition, an inking unit 85 can be moved on the guide element 72. In the print on position shown in FIG. 3, the inking unit 85 can be set against the plate cylinder 74. Similarly, an image setting unit 86 can be permanently arranged on the machine frame support 70 in front of one end of guide element 75 and an inking unit 87 can be arranged so that it can be displaced on the guide element 75. The image setting device 86 and the inking unit 87 cooperate with the plate cylinder 77. The inking units 85 and 87 are arranged to move in the direction of movement of their associated cylinders, 74 and 76 respectively.

In order to transfer the printing unit cylinders of each printing unit into the print-off position, the plate cylinders 74, 77 are first moved in the direction of the image setting devices 84, 86 while the inking units 85, 87 are moved in the opposite direction. This creates space for the transfer cylinders 82, 83 to then be moved away from each other. If the printing unit cylinders are cantilever mounted on the machine frame support, the sleeves on the plate cylinders 74, 77 can then be changed. However, if the printing unit cylinders are guided in a machine frame support at both ends, then one of the supports must be folded down or moved away. One such arrangement is disclosed in U.S. patent application Ser. No. 09/635,155.

In the embodiment shown in FIG. 3, the guide elements 72, 75 perform three functions. First, they set the plate cylinders 74, 77 on and off the transfer cylinders 82, 83. Second, they guide the plate cylinders 74, 77 as they are brought into engagement with the image setting devices 84, 86. Finally, they guide the inking units 85, 87.

In this embodiment the image setting units 84, 86 are arranged to be fixed. However, it is also possible to guide this device in the same manner as the inking unit 85, 87 so that it can be moved on the guide elements 72, 75 which extend as far as these additional devices. It then becomes possible for the image setting devices to be moved with respect to the associated cylinder 74, 77 in the direction of movement of the associated cylinder 74, 77 in the image setting direction.

Figure 4:
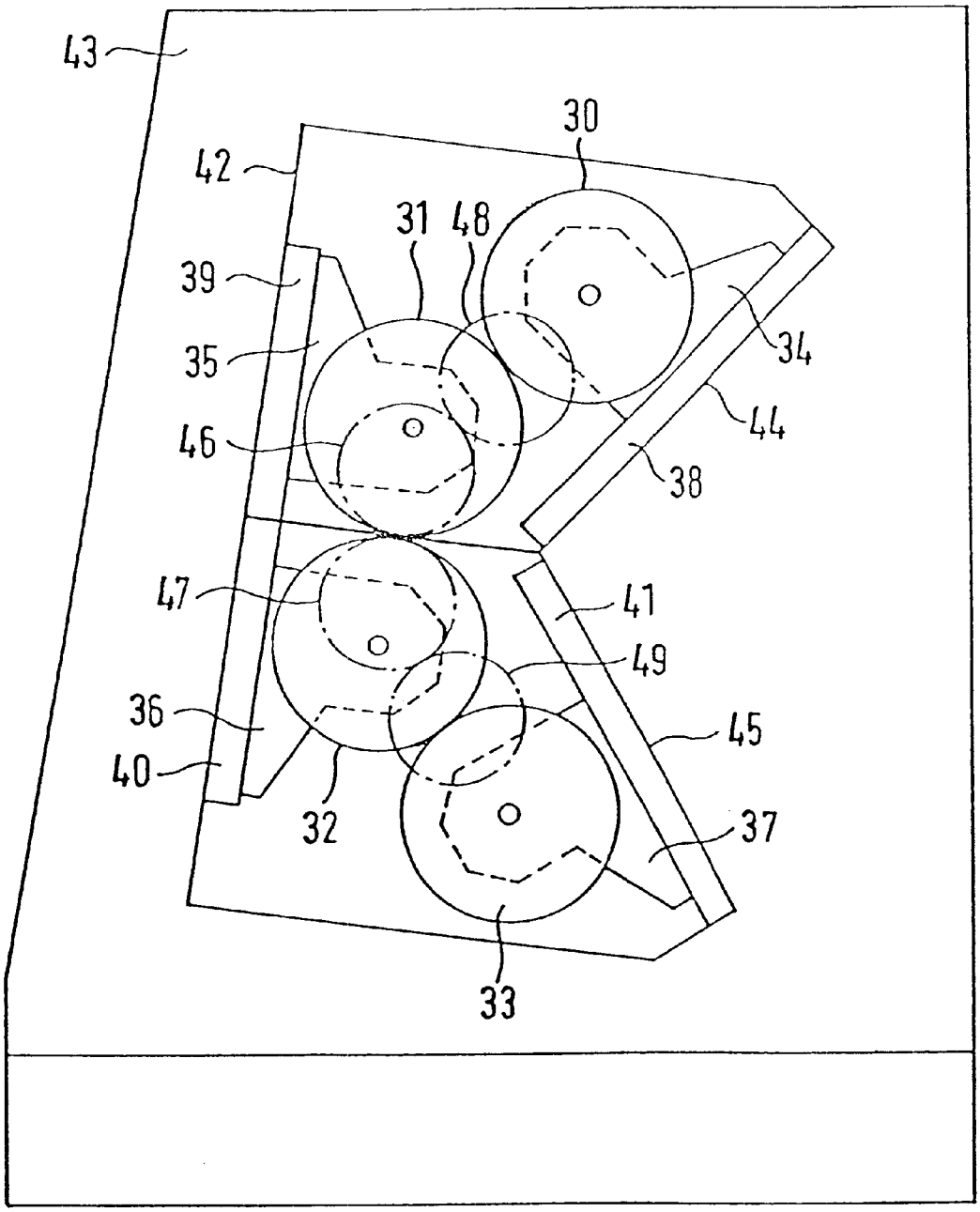
FIG. 4 is a further embodiment of the present invention in an illustration.

Referring now to FIG. 4, a further embodiment of the printing unit according to the present invention is shown having four printing unit cylinders 30–33, which are rotatably mounted on carriages 34–37. The carriages 34–37 are guided so that they can be displaced on guide elements 38–41 that extend rectilinearly. In this embodiment, the guide elements 39, 40 for the inner printing unit cylinders 31, 32 are fitted so that they are aligned on a continuous wall 42 of the machine frame support 43. The guide elements 38, 41 for the carriages 34, 37 of the outer printing unit cylinders 30, 33 are fitted to walls 44, 45 so that they run towards each other in a V shape. The walls are arranged to run obliquely towards the guide elements 39, 40 in the same way as guide elements 38, 41. The mounting and driving of the carriages of this embodiment are designed in the same way as in the first embodiment.

This configuration provides the advantage that only three walls 42, 44, 45 of the machine frame 43 have to be machined with the required accuracy. There is also the option, as indicated by the printing unit cylinders 46–49 of smaller diameter to be able to use printing unit cylinders of different diameter in the same machine frame support.

FIG. 4 shows the printing unit cylinders 30–33 in the print-on position. In order to transfer them into the print-off position, the printing unit cylinders 30, 33 are moved obliquely up and down, respectively. Similarly, the printing unit cylinders 31, 32 are moved up and down respectively. In this position, a sleeve or cylinder change is possible, just as in the first embodiment.

Figure 5:
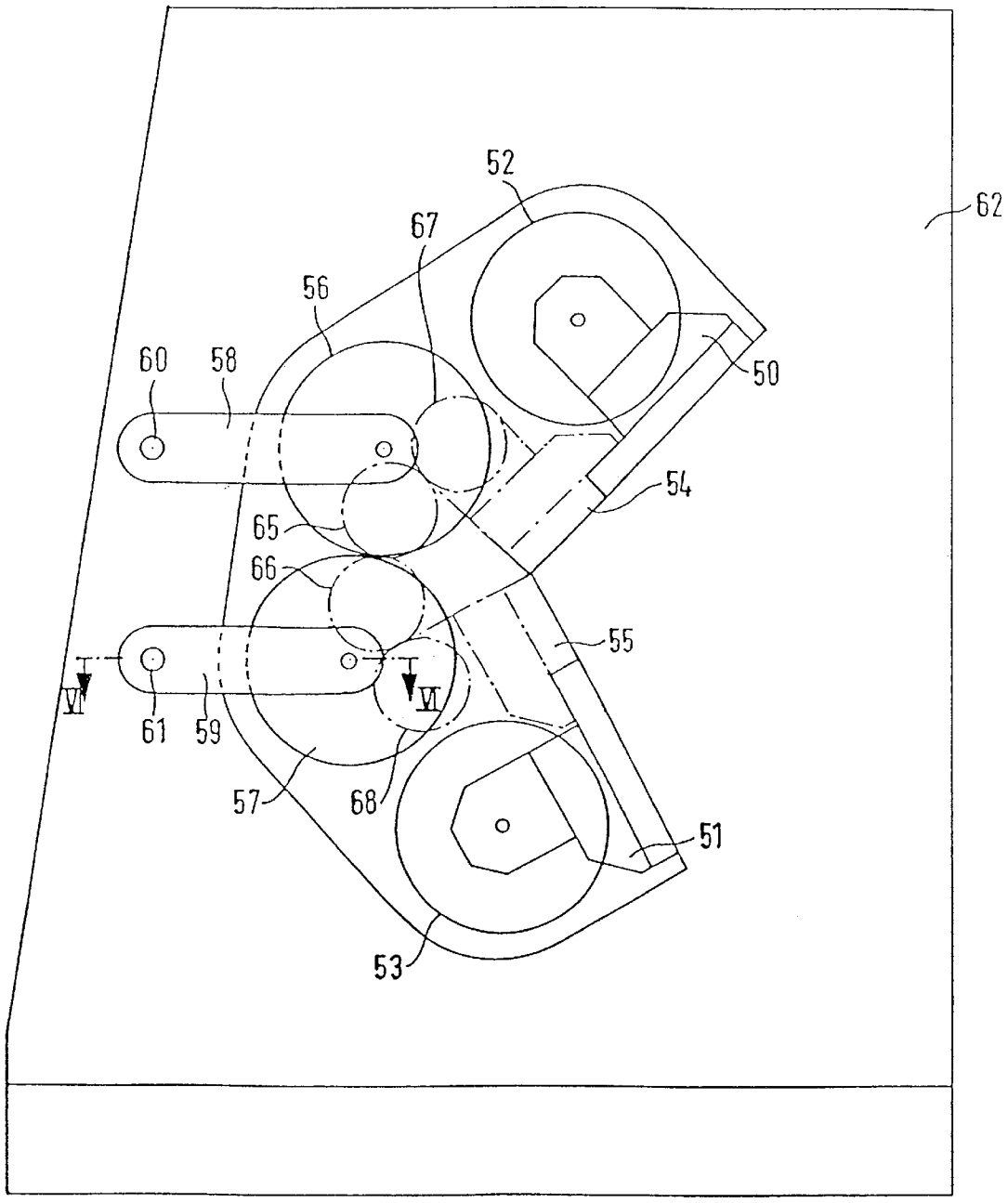
FIG. 5 is another embodiment of the present invention.
Figure 6:
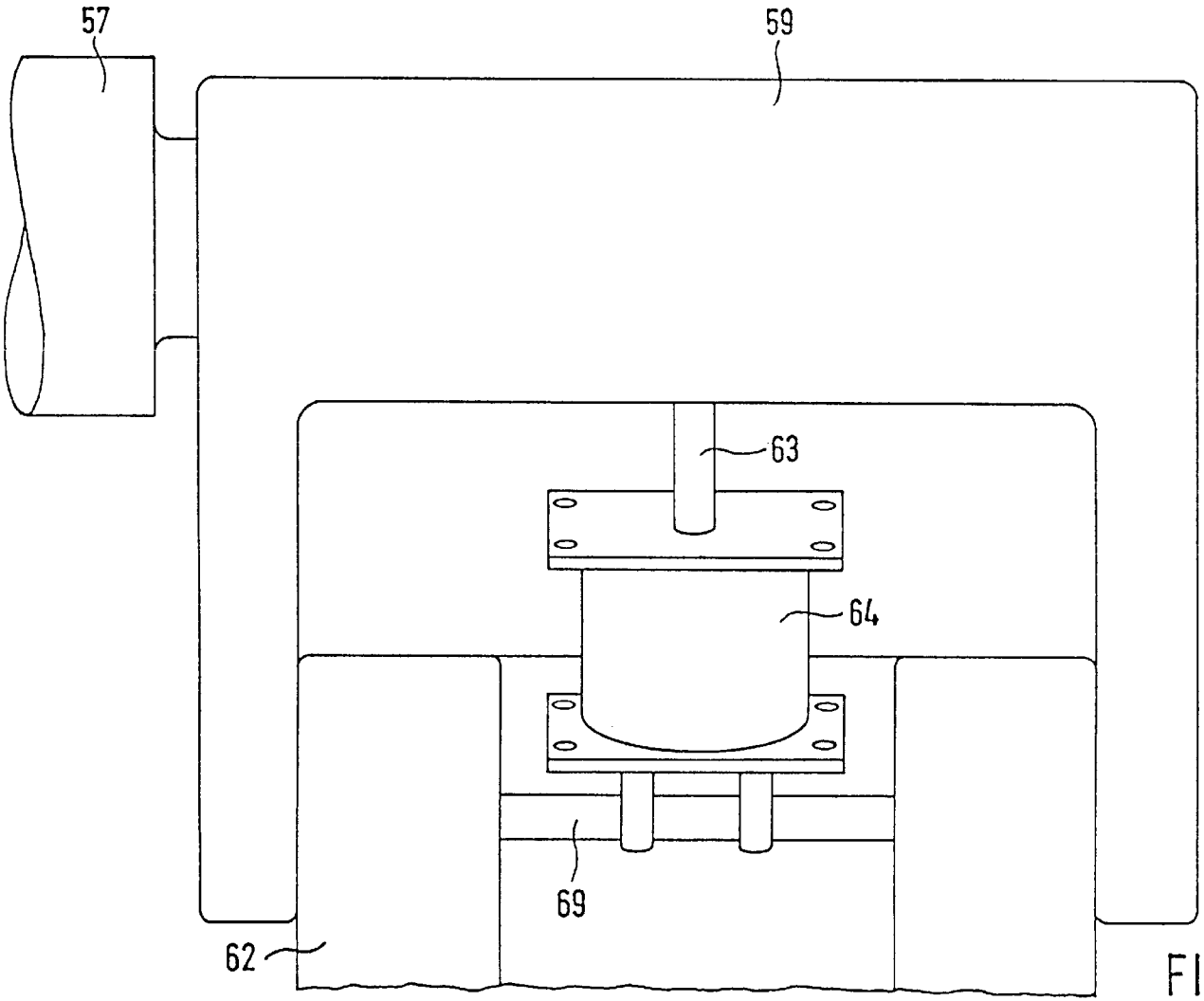
FIG. 6 is a sectional view along the VI—VI line in FIG. 5.

Referring now to FIGS. 5 and 6, a further embodiment of the present invention is shown. In this embodiment, the carriages 50, 51 are again guided so that they can be displaced on two rectilinear guide elements 54, 55 which run toward each other in a V shape. The inner printing unit cylinders 56, 57 are each rotatably mounted on a swinging arm 58, 59 which accommodates a drive motor (not illustrated) for these printing unit cylinders 52, 53. Each swinging arm 58, 59 is mounted on a machine frame support 62 so that it can pivot around a pin 60, 61. As a drive motor, a piston rod 63 of an associated hydraulic or pneumatic cylinder 64 engages on one end on a swinging arm. The other end is pivotally attached to an axle 69 that is permanently arranged in the machine frame support 62. This arrangement for mounting the inner printing unit cylinders 56, 57 can be made cost effectively while supplying the adjustment accuracy required for the printing unit cylinders.

In order to transfer the printing unit cylinders 52, 53 to the print-off position, 15 the carriages 50, 51 are moved outward. The inner printing unit cylinders 56, 57 are then pivoted away from one another by the swinging arms 58, 59. This printing unit can also be equipped with smaller printing unit cylinders 65–68 as shown.

This invention is not limited to the embodiments illustrated. Specifically, it is possible to provide an approximately vertical web run rather than an approximately horizontal web run. For this purpose, the guide elements have to be rotated 90°.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. It is the intention, therefore, to be limited only as indicated by the scope of the claims appended hereto.

We claim:

1. A printing unit for a web fed rotary printing machine, comprising:

a machine frame support;

two sets of printing unit cylinders, each set comprising an outer printing unit cylinder and an inner printing unit cylinder, the two sets being arranged so that a web is printable between the inner printing unit cylinders of the two sets;

a plurality of carriages, wherein each carriage corresponds to one printing unit cylinder for rotatably mounting its corresponding printing unit cylinder on the machine frame support;

a drive motor for each cylinder; and two sets of guide elements arranged on the machine frame for determining a travel setting of the plurality of carriages along the machine frame support, one of the two sets of guide elements including guide elements for only the outer cylinders the other of the two sets of guide elements including guide elements for only the inner cylinders, the guide elements for the outer cylinders being arranged on the machine frame support in a different direction than the guide elements for the inner cylinders, so that movement of the outer printing unit cylinders is along a different path than movement of the inner printing unit cylinders, the movement paths extending along planes that intersect.

2. The printing unit according to claim 1, wherein the guide elements of at least the outer printing unit cylinders comprise rectilinear guide rails.

3. The printing unit according to claim 1, comprising two outer printing unit cylinders and two inner printing unit cylinders, the guide elements for the inner printing unit cylinders being spaced apart from and run parallel to each other.

4. The printing unit according to claim 1, wherein the guide elements for the carriages corresponding to the plurality of outer printing unit cylinders are arranged in a V shape.

5. The printing unit according to claim 4, wherein the guide elements for the carriages corresponding to the plurality of inner printing unit cylinders run rectilinearly and are aligned linearly.

6. The printing unit according to claim 4, wherein the guide elements for the inner printing unit cylinders comprise swinging arms having a first end and a second end, the first end being pivotally attached to the machine frame support, the second end being attached to a corresponding cylinder so that the inner printing unit cylinders are swingable to permit the printing unit cylinders to have differing diameters.

7. The printing unit according to claim 6, further comprising a motor corresponding to each swinging arm for actuating the corresponding swinging arm.

8. The printing unit according to claim 1, wherein the guide elements comprise guide rails that run rectilinearly, and wherein the machine frame support comprises a wall extending in a travel direction of the printing unit cylinders and running perpendicular to a plane through an end face side of the printing unit cylinders, the guide rails being arranged on the wall.

9. The printing unit according to claim 1, wherein the plurality of outer printing unit cylinders comprise plate cylinders, and further comprising:

at least one additional printing device corresponding to each of the plate cylinders, the at least one additional printing device being arranged to be movable in a direction of movement of its corresponding plate cylinder.

10. The printing unit according to claim 9, wherein each plate cylinder is capable of movement in a working direction of the corresponding at least one additional printing device.

11. The printing unit according to claim 9, wherein the set of guide elements corresponding to the outer printing unit cylinders extends as far as the at least one additional printing device.

12. The printing unit according to claim 9, wherein the additional printing device comprises at least one inking unit movable toward the corresponding plate cylinder.

13. The printing unit according to claim 12, wherein the plate cylinder is moveable towards the corresponding inking unit.

14. The printing unit according to claim 9, wherein the additional printing device comprises an inking unit, the plate cylinder being movable towards the inking unit.

15. A printing unit for a web fed rotary printing machine, comprising:

a machine frame support;

two sets of printing unit cylinders, comprising a plurality of outer printing unit cylinders and a plurality of inner printing unit cylinders, the plurality of outer printing unit cylinders including plate cylinders;

a plurality of carriages, wherein each carriage corresponds to one printing unit cylinder for rotatably mounting its corresponding printing unit cylinder on the machine frame support;

a drive motor for each cylinder;

two sets of guide elements arranged on the machine frame for determining a travel setting of the plurality of carriages along the machine frame support, one of the two sets guide elements including guide elements for only the outer cylinders the other of the two sets of guide elements including guide elements for only the inner cylinder, the guide elements for the outer cylinders being arranged on the machine frame support in a different direction than the guide elements for the inner cylinders, so that movement of the outer printing unit cylinders is along a different path than movement of the inner printing unit cylinders, the movement paths extending along planes that intersect; and at least one additional printing device corresponding to each of the plate cylinders, the at least one additional printing device being arranged to be movable in a direction of movement of its corresponding plate cylinder, the set of guide elements corresponding to the outer printing unit cylinders extends as far as the at least one additional printing device, the additional printing device being moveable on the corresponding guide element.

16. The printing unit according to claim 15, wherein the additional printing device comprises at least one image setting unit movable in the direction of movement of the corresponding plate cylinder.

17. The printing unit according to claim 16, wherein the plate cylinder is moveable with respect to the corresponding image setting unit in an image setting direction.

18. The printing unit according to claim 15, wherein the additional printing device comprises an image setting unit, the plate cylinder being movable with respect to the image setting unit in an image setting direction.

19. A printing unit for a web fed rotary printing machine, comprising:

a machine frame support;

two sets of printing unit cylinders, comprising a plurality of outer printing unit cylinders and a plurality of inner printing unit cylinders;

a plurality of carriages, wherein each carriage corresponds to one printing unit cylinder for rotatably mounting its corresponding printing unit cylinder on the machine frame support;

a drive motor for each cylinder; and two sets of guide elements arranged on the machine frame for determining a travel setting of the plurality of carriages along the machine frame support, the guide elements for the outer cylinders being arranged on the machine frame support in an orientation different than the guide elements for the inner cylinders, so that movement of the outer printing unit cylinders is along a different path than movement of the inner printing unit cylinders, the cylinders comprising two outer printing unit cylinders and two inner printing unit cylinders, the guide elements for the inner printing unit cylinders being spaced apart from and run parallel to each other, the guide elements corresponding to the outer printing unit cylinders being spaced apart from and running parallel to each other and are inclined with respect to the guide elements for the inner printing unit cylinders.

20. The printing unit according to claim 19, wherein the guide elements for the outer printing unit cylinders run approximately parallel to a printing material web fed between the inner printing cylinders.

* * * * *